US005159178A

United States Patent [19]

Chen

[11] Patent Number: 5,159,178

[45] Date of Patent: Oct. 27, 1992

[54] ELECTRIC STOVE FOR KITCHEN

[76] Inventor: Mao-Sai Chen, No. 391, Hsin-Sheng Road, Chia-Li Town, Tainan Hsien, Taiwan

[21] Appl. No.: 664,882

[22] Filed: Mar. 5, 1991

[51] Int. Cl.[5] ..... H05B 3/72

[52] U.S. Cl. ..... 219/465

[58] Field of Search ..... 219/465, 463, 467, 433, 219/436, 438

[56] References Cited

U.S. PATENT DOCUMENTS

| | | | |
|---|---|---|---|
| 1,380,753 | 6/1921 | Trouilhet | 219/463 |
| 2,496,654 | 2/1951 | Alsdorf | 219/463 |
| 3,010,006 | 11/1961 | Schwaneke | 219/438 |
| 3,141,090 | 7/1964 | Batcher | 219/438 |
| 4,270,067 | 5/1981 | Thomas | 219/438 |

*Primary Examiner*—Teresa J. Walberg

*Attorney, Agent, or Firm*—Morton J. Rosenberg; David I. Klein

[57] ABSTRACT

An electric stove for kitchen has a base, an outer ring frame, an electric hot-plate and fixed supports, etc. The main characteristic of the present invention is in that the outer ring frame is easy to be exactly locked on the circular groove of the base by penetrating screws into bigger bored bakelite washers, bigger holes of the flanges of the circular groove and another bigger bored bakelite washers in order and then screwing up nuts tightly, by which the generated hollow space between bakelite washers and nuts being the result of screwing the circular groove of the base and the outer ring frame in suspension can reach better effect in heat insulation. Moreover, the simple method of screwing a calorific member and a protruding iron cover covering outside the calorific member to the electric hot-plate is very helpful for repairmen to fix broken-down calorific members.

3 Claims, 3 Drawing Sheets

ELECTRIC STOVE FOR KITCHEN

BACKGROUND OF THE INVENTION

1. Field of the Invention

This invention relates to an electric stove for kitchen use whose base and outer ring frame are easily assembled. Additionally, specifically designed length projecting racks or U-shaped bracket members are mounted beneath the electric hot-plate for achieving a high degree of heat insulation. This invention is further directed to an electric hot-plate whose heating element is easily assembled and/or replaced for repair.

2. Description of the Prior Art

Electric stoves known and used in the prior art are in general formed of bases, outer ring frames, and electric hot-plates. When assembling bases and outer ring frames, manufacturers normally glue the circular grooves onto the bases, place the outer ring frames exactly on the circular grooves of the bases, and then tightly compress the outer ring frames to the circular grooves of the bases. However, this kind of construction and compressing method is unsatisfactory because the high temperatures generated by the heating elements often soften the adhesive. Moreover, this method is time consuming and tedious, since numerous steps such as gluing, positioning, and mechanical compressing, are required.

Furthermore, known prior art electric stoves have aluminum-cast hot-plates and heating elements which cannot be disassembled easily. Such prior art systems increase the production costs which results in a respective and unacceptable resulting cost to the consumer.

SUMMARY OF THE INVENTION

The principal object of the present invention is to provide an outer ring frame with holes or openings which are combined with the base by through screws or threaded members that pass through the openings of oversized thermally insulated washers, oversized holes of a circularly contoured recessed portion of the base, another oversized thermally insulated or bakelite washer, and then fastening by means of nuts from the bottom of the base. A hollow space between bakelite washers and nuts prevent the heat generated by the heating element from being directly conducted into the base of the electric stove. Thus, efficient heat insulation is achieved.

It also is an object of the present invention to provide several length projecting racks or U-shaped bracket members positioned beneath the electric hot-plate fastened with bakelite washers so as to achieve better heat insulation.

Another object of the present invention is to provide a semi-circular sectional heating element covered by a central protruding iron cover, by which a simple mounting threaded member or screw penetrates into the central hole of the iron cover, the central part of the heating element, and a hole or opening in the central flange of the electric hot-plate to easily fasten or release the iron cover, the heating element, and the electric hot-plate when repairing a damaged heating element.

Still another object of the present invention is to provide fixed supports or brackets between flange lugs of the base and the length projecting racks of the electric hot-plate for supporting the iron cover.

According to the preferred embodiments of the present invention having these objects, there are some apparent advantages described as follows:

1. The combination of the base and outer ring frame by screws or threaded members is a simplified arrangement and can greatly lower the cost of manufacture.

2. Since the holes of the outer ring frame, the circular groove of the base and the bakelite washers are specially designed to be larger than the securing bolts, the hollow space between bakelite washers and nuts can prevent or minimize the heating element from conducting heat to the base.

3. Moreover, the length projecting racks or U-shaped bracket members beneath the electric hot-plate extend the distance of the electric hot-plate and the base so as to have better heat insulation.

4. When the heating element is damaged, such is simple and convenient to repair.

5. The specially designed fixed supports with one of their ends attaching to the edge of the screw iron cover can provide a better supporting function and make the heating element conduct heat to the electric hot-plate more efficiently.

6. The assembly of the whole electric stove is of simple design.

7. The production of the electric stove is very simple and the cost can be greatly lowered.

BRIEF DESCRIPTION OF THE DRAWINGS

The invention will be better understood by reference to the accompanying drawings, wherein.

DESCRIPTION OF THE PREFERRED EMBODIMENTS

Figure 1:
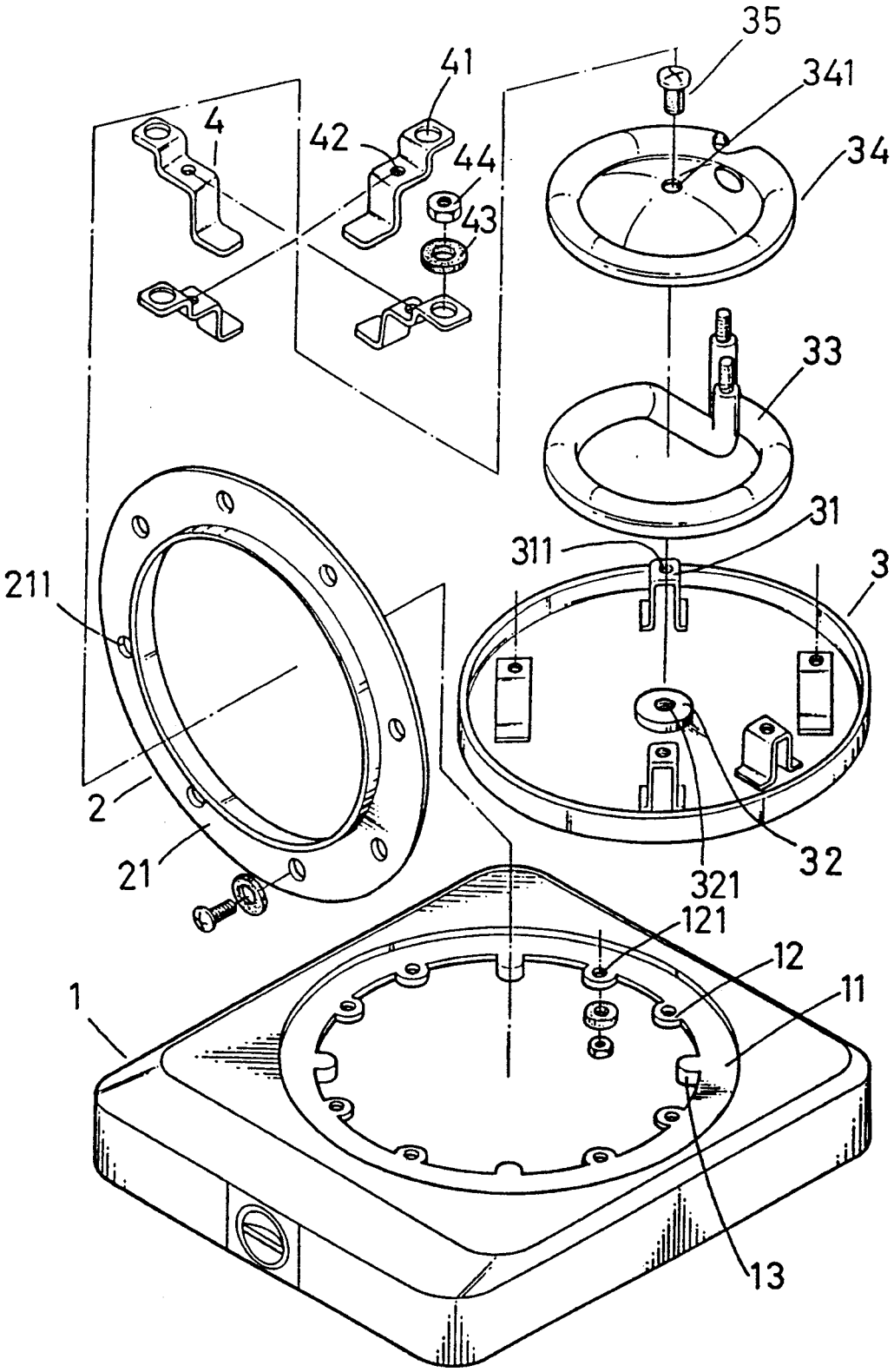
FIG. 1 is a perspective blow out view showing the electric stove assembly.

As shown in FIG. 1, the present invention is concerned with an electric stove for kitchen use including a base member 1, an outer ring frame 2 and an electric hot-plate 3.

Figure 3:
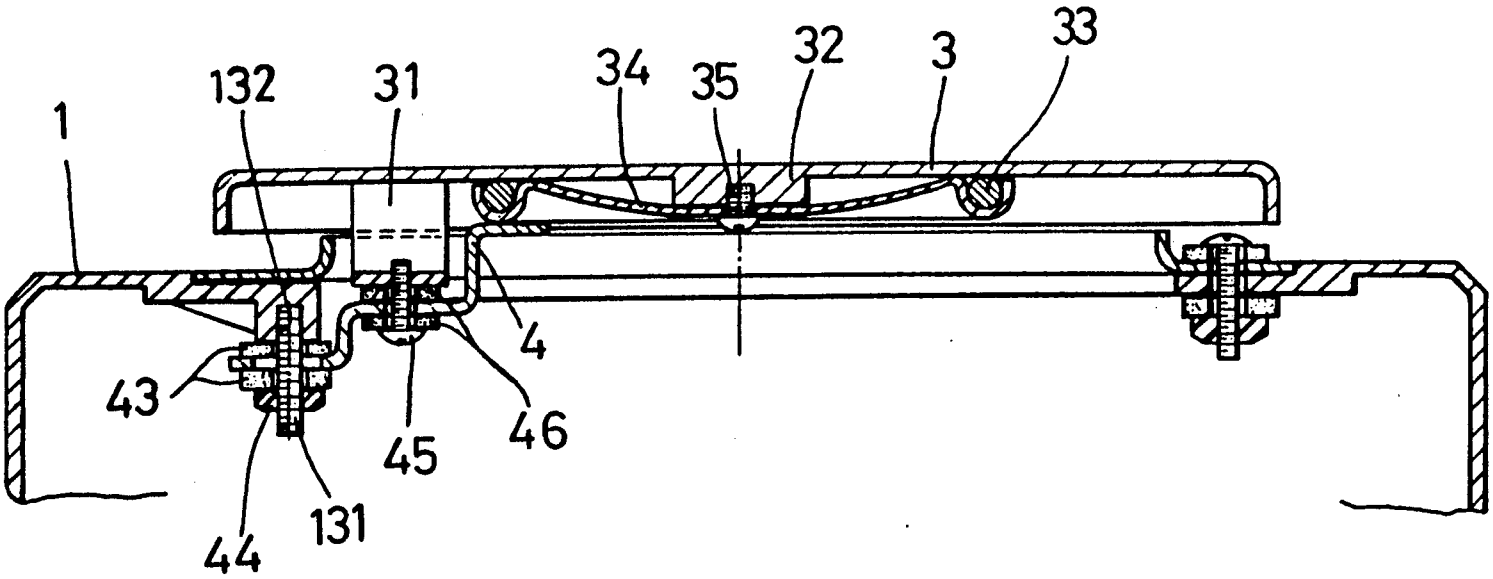
FIG. 3 is an elevational sectional view of the electric stove.

The base 1 defining a hollow shell has a circular groove or contoured recess portion 11 formed within a top surface. As shown in FIGS. 1 and 3, around the inside edge of the circular groove 11 at equally spaced distances, are a plurality of flanges 12 with holes or openings 121 and flange lugs 13 having openings 132 within which are secured bolts 131 as shown in FIG. 3.

The outer ring frame 2 being a hollow projecting ring has holes 211 formed through circular side 21 at equally spaced radial distances, whose positions align with holes 121 of the flanges 12 of the circular groove or recessed portion 11 of the base 1. The electric hot-plate 3 has length projecting racks or U-shaped brackets 31 with holes 311 formed through a bottom wall. The U-shaped brackets 31 and holes 311 are positionally aligned with the flange lugs 13 of the circular groove 11 of the base 1. Additionally, beneath the central bottom surface of the electric hot-plate 3, there is a flange 32 with a tap hole 321. A semicircular sectional heating element 33 is attached to the central bottom surface of the electric hot-plate 3 and a protruding iron cover 34 covers the heating element 33. A screw 35 is inserted into the central hole 341 of the iron cover 34 and passes into the central flange 32 of the electric hot-plate 3. The fixed supports 4 with holes 41 larger than bolts to be used, are placed between the flange lugs 13 of the base 1 and the length projecting racks 31 of the electric hot-plate 3.

Figure 2:
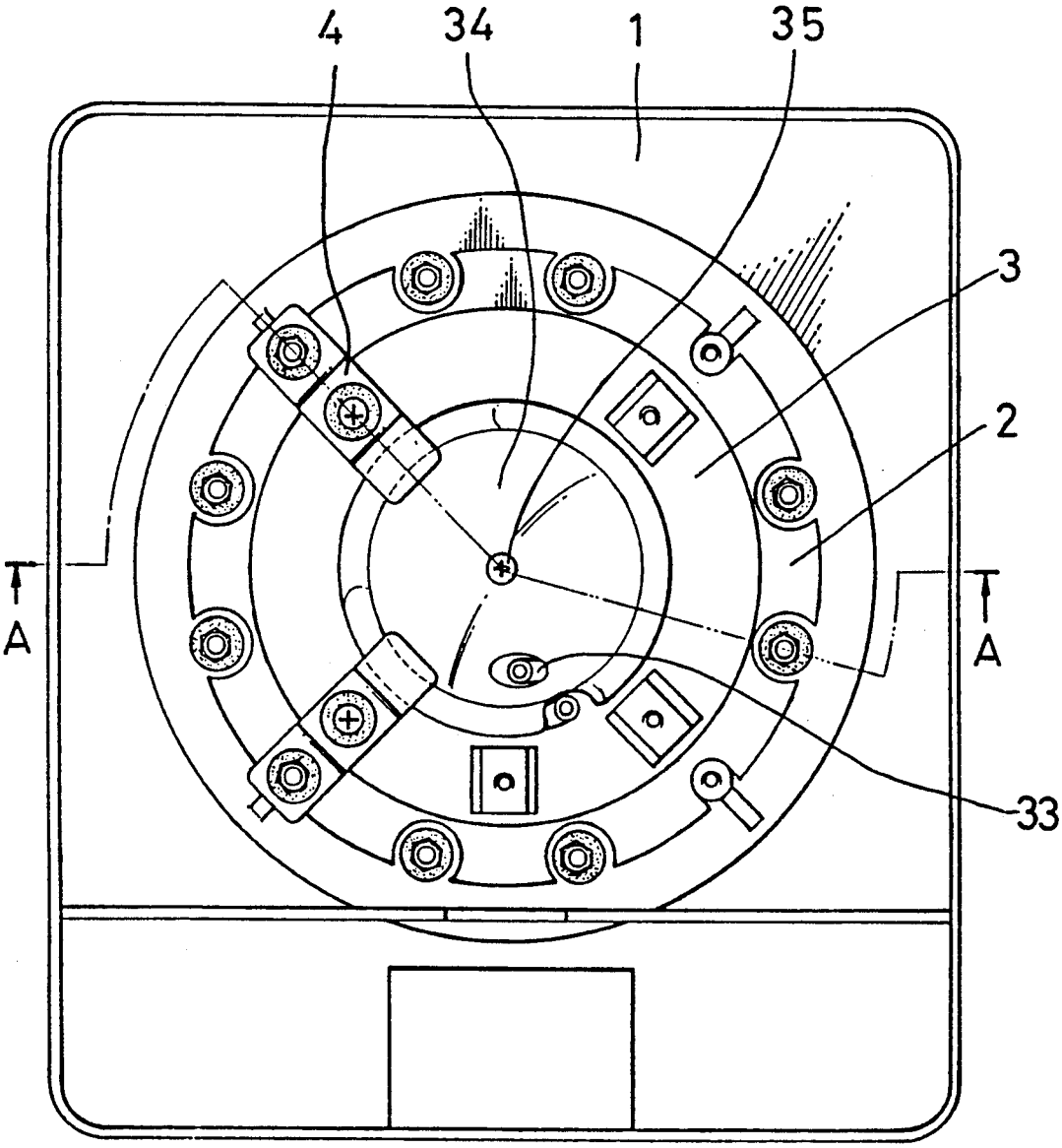
FIG. 2 is a bottom plan view showing the assembly of the electric stove.

When assembling the electric stove, the circular side 21 of the outer ring frame 2 fits exactly or matingly on the circular groove 11 of the base 1. The bakelite washer 43 is inserted and fixed supports 4, bakelite washer 43 are secured to pre-connected bolts 131 which are beneath the flange lugs 13 of the base 1 before tightening. The screwed fixed supports 4 have their middle portions fastened by using screws 45 to penetrate the screw bakelite washer 36, the central holes 42, another bakelite washer 46, and the holes 311 of the length projecting racks 31 in sequential order, by which the heating element 33 is supported, and can transmit heat into the electric hot-plate 3 as shown in FIGS. 2 and 3.

When a power switch of the electric stove is actuated, the heating element 33 transmits heat to the surface of the electric hot-plate 3. However, the improved method of fastening the base 1 and the outer ring frame 2 in suspension and the special design of the length projecting racks 31 provide for better heat insulation.

Moreover, when the heating element 33 is broken, it is easy to repair by simple removal of a single screw 35 which fixes the iron cover 34 and the heating element 33 to the electric hot-plate 3.

While the preferred embodiments of the invention have been described above, it will be recognized and understood that various modifications may be made therein and the appended Claims are intended to cover all such modifications which may fall within the spirit and scope of the invention.

What is claimed is:

1. An electric kitchen stove comprising:

a base member having a circular opening and equally spaced apart flanges directed internal said opening defining a circularly contoured recessed portion; said flanges having predetermined diameter openings passing therethrough, said circularly contoured recessed portion for receiving an outer ring frame member, said outer ring frame member formed with equally spaced apart frame openings for alignment with said equally spaced apart flanges within said circularly contoured recessed portion of said base member;

said outer ring frame member and said base member detachably secured with threaded members having a thread diameter less than said predetermined diameter of said flange openings;

said outer ring frame and said base member being held in spaced apart relationship by thermal insulation washers having washer openings of predetermined diameter greater than said diameters of said threaded members; and, an electric hot-plate having a semi-circular sectional heating element member and a protruding iron cover for said heating element fixedly secured each to the other by means of a threaded member secured through a central hole in said iron cover, said electric hot-plate being threadedly secured to said spaced apart flanges of said base member.

2. An electric kitchen stove as recited in claim 1, including a plurality of projecting U-shaped bracket members secured to a bottom surface of said electric hot-plate and said flanges.

3. An electric kitchen stove as recited in claim 2, including fixed brackets secured beneath said projecting U-shaped bracket members and said flanges of said base member.

* * * * *